United States Patent [19]

Lonardo

[11] Patent Number: 4,797,210

[45] Date of Patent: Jan. 10, 1989

[54] AUTOMATICALLY CONTROLLED WATER BUOYANT POLLUTION-SKIMMER-AND-RECOVERY SYSTEM

[76] Inventor: Vincent P. Lonardo, 2642 Salt Springs Rd., Girard, Ohio 44420

[21] Appl. No.: 39,213

[22] Filed: Apr. 17, 1987

[51] Int. Cl.[4] ..... E02B 15/04

[52] U.S. Cl. ..... 210/242.3; 210/923

[58] Field of Search ..... 210/242.3, 776, 923

[56] References Cited

U.S. PATENT DOCUMENTS

| | | | |
|---|---|---|---|
| 3,722,688 | 3/1973 | Nirshing | 210/923 |
| 3,722,689 | 3/1973 | Markel et al. | 210/923 |
| 4,038,182 | 7/1977 | Jenkins | 210/242.3 |
| 4,554,070 | 11/1985 | Jordan | 210/923 |
| 4,564,449 | 1/1986 | Kampers | 210/923 |

*Primary Examiner*—Benoit Castel
*Assistant Examiner*—Richard D. Jordan
*Attorney, Agent, or Firm*—Eugene M. Bond

[57] ABSTRACT

This invention relates to an automatically controlled water bouyant pollution-skimmer-and-recovery system which collects lighter than water contaminants in a simple efficient manner such that the contaminants are concentrated for either disposal or reuse while the water is rendered significantly pollution free and safe for return to the environment.

7 Claims, 2 Drawing Sheets

AUTOMATICALLY CONTROLLED WATER BUOYANT POLLUTION-SKIMMER-AND-RECOVERY SYSTEM

BACKGROUND OF THE INVENTION

This invention relates to a process for the processing of crude petroleum, various oil fractions and oily wastes. More particularly, it relates to a system for removing contaminants such as petroleum and oily substances, whether crude or refined, by means of a simple efficient unit as a way of, for example, cleaning up oil spillage as it may occur on the open sea, inland fresh waters, rock-bound shorelines, tidal pools and harbors and for cleaning various industrial effluent waste materials. The invention is also applicable for cleaning closed containers, such as, for example, tanker bottoms or storage tanks, cooling towers and the like containing crude petroleum, heavy tar fractions, asphalts and heavy, viscous crude oil residues.

Environmental cleanup is of much concern to the country and to the world today. Air and water pollution are a major problem in today's technological society. As far as water pollution is concerned, oil spillage has become an increasing problem with the advent of off-shore drilling and the transport of petroleum in very large tankers. Many proposals have been made for cleaning up and/or degrading such oil spillages, but none has been satisfactorily successful to date. Moreover, there is much public concern over the pollution problems caused by the discharge of effluent waste materials into waterways, and various governments are enacting much stricter standards regarding the contaminant or polluting composition of such effluents.

Ideally, the desired end result of oil or waste material degradation is to restore oil-polluted marine, benthic and littoral environments to habitable, ecologically clean environments. The use of materials primarily of biological origin which are not only bio-degrading, but are also edible, beneficial and completely non-toxic to marine fauna and flora, would be especially advantageous. Synthetic detergents, emulsifying agents, organic solvents or other toxic products of the chemical process or the petrochemical industries, proposed heretofore, do not possess the advantages inherent in the use of materials of biological origin. In fact, the use of synthetic chemicals very often results in the massive killing of marine fauna and flora over a wide geographical area. Accordingly, most of the approaches used in the past, whether mechanical or chemical in nature, have been unsatisfactory.

SUMMARY OF THE INVENTION

In accordance with the present invention, the above objects and advantages as well as others as will become more apparent from the following specification, detailed description and appended claims.

By practice of the present system using the apparatus disclosed, it is possible to separate in an efficient manner, lighter than water pollutants or contaminants. However, for simplicity of description, the present invention will be described with regard to oil contaminated water and similarly related pollutants.

In addition to oil, the present system will remove most any floating object which is sufficiently bouyant to cascade over the weirs.

Because the weirs operate at a level just below the interface of the oil-water level, absent any oil on the water does not stop operation of the unit. Water simply becomes processed through the system.

It is applicable equally to petroleum degradation and to other industrial wastes in general, such as effluents from food canning or preparing factories, paper mills, steel and aluminum mills, dairies and chemical plants discharging solvents, plasticizers, phenolics and other organic compounds which float on water into the environment.

The expression "petroleum" as used throughout this application is intended to designate crude petroleum as well as petroleum fractions and petroleum-derived products, such as aliphatic and aromatic hydrocarbons, phenols, naphthalenes, phenanthrenes, anthracenes, organic esters, etc. Thus, the term "petroleum" as used herein refers to organic carbon-containing compounds, including straight-and-branched-chain alkanes (including paraffins of varying molecular weights) and other aliphatic compounds (including alicyclics such as cyclohexane) as well as aromatic heterocyclic and carbocyclic compounds. In industry, the term "oily waste" is used to designate effluents or mixtures which may contain one or more of the following components: oils, heat exchanger fluids, hydraulic fluids, polychlorinated biphenyls (PCB's), brominated hydrocarbons, organic solvents, phenolics, naphthenics, coolants, cutting oils, effluent and raw sewage. Oily wastes containing these kinds of materials can be and have been claimed in the present application.

One of the objects of this invention is to provide an improved system for cleaning up oil spills in a simple, efficient manner without experiencing deficiencies known in the prior art.

Another object of the present invention is to provide an improved system for recovering oil fractions from oily wastes including industrial effluents to a level where water may be discharged into the environment safely and without concern of pollution in accordance with governmental standards.

Yet another object of this invention is to provide a method and apparatus for easily and efficiently removing lighter than water contaminants from the surface of the water without ecological damage resulting during the separating process.

These and other objects and advantages will become apparent to those skilled in the art from consideration of the following specification taken in conjunction with the appended claims.

The present system operates on the principle that water has a surface tension such that oil-type contaminants float as a film thereon. Fundamentally, the present pollution-skimmer-and-recovery system recovers oil-type contaminants by creating a falling cascade which automatically adjusts to approximately the contaminant and water interface. As a result, the oil-type contaminant is drawn over an oscillating weir, into a catch basin from which the recovered oil-type contaminants are pumped to a more refined conventionally available concentrator. Once the oil-type contaminants are recovered from the water using the pollution-skimmer-and-recovery system, the water may be returned safely to the environment, and the recovered contaminants may be either recovered for re-use or otherwise safely disposed according to conventional practice.

DETAILED DESCRIPTION OF THE PRESENT INVENTION

Practice of the present invention will become more readily apparent from the following more detailed description wherein similar elements are represented by like numerals through the several views, taken in conjunction with the drawings wherein.

The automatically controlled water bouyant pollution-skimmer-and-recovery system may vary in size as desired. The system may vary in size from one sufficiently large to recover ocean size oil spills, to one sufficiently small to collect oil spills in small tanks.

The present system may be configurated to remove about four (4) to about five (5) square inches of oil-type contamination per second.

The cascade is created by means of floating barriers or weirs which are rendered bouyant by suitable flotation means such as styrofoam which are attached to each of the weirs. When the weirs pivot upright, contaminated water is blocked from entry to the cascade. However, as the pump lowers the level of the water in the hull section of the present system, the unit becomes more bouyant and rises. When the unit rises, the weirs lower to a level near the interface of the contamination layer and the water thereby renewing the cascade of contaminants into the hull portion. The cycle continues by loading contaminated water into the hull, the hull becomes less bouyant and begins to submerge causing the weirs to rise by pivoting upwardly to again block the contaminants from the cascade. The cycle continues to repeat substantially automated as long as contaminants remain on the water surface.

Because the system acts as a sink for the contaminants, and because of the surface tension of the contaminants, there exists a steady consistent force which pulls the contaminants along the surface of the water, over the cascade and into the hull section of the system.

Although the pump is illustrated above the water line, which is within the intent of the present invention, it is found that by submerging a water-submergable pump into the water-oil of the hull of the unit, the submerged pump stays cooler over long periods of operation. The exposed pump, although operable, is found to be heated both by internal operation and by the heat of the sun. That combination of heating factors combines to limit the useful life of the exposed pump. In contrast, the submerged pump operates cooler since any heat buildup is dissipated by the cooler water-oil contamination.

Figure 1:
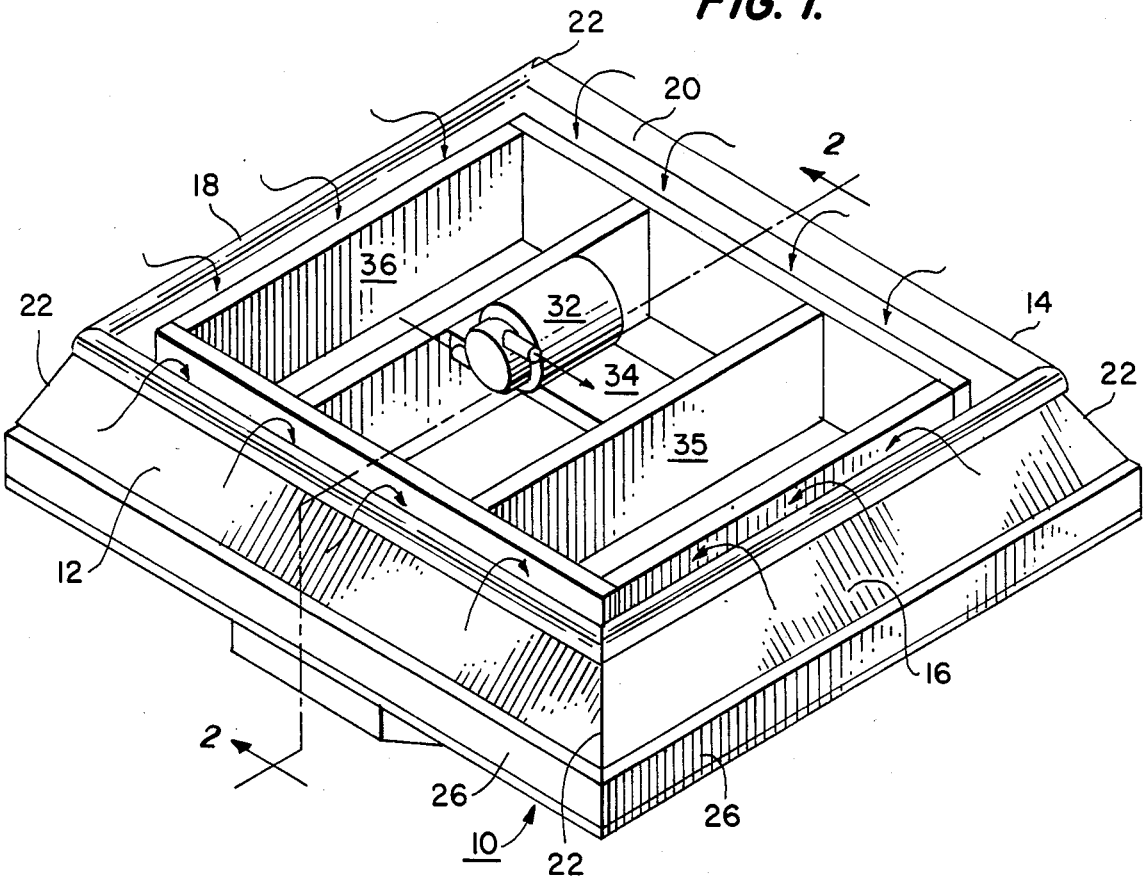
FIG. 1 is a top perspective view of the flotation section of the present system.
Figure 2:
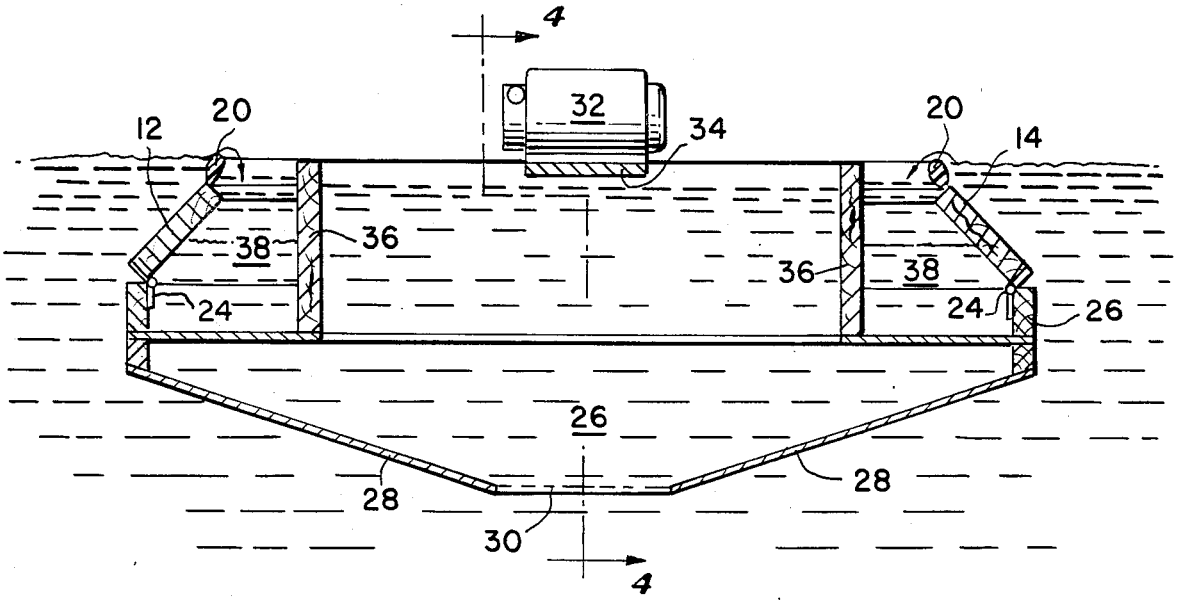
FIG. 2 is a right side elevational view taken along section lines 2—2 of FIG. 1.
Figure 3:
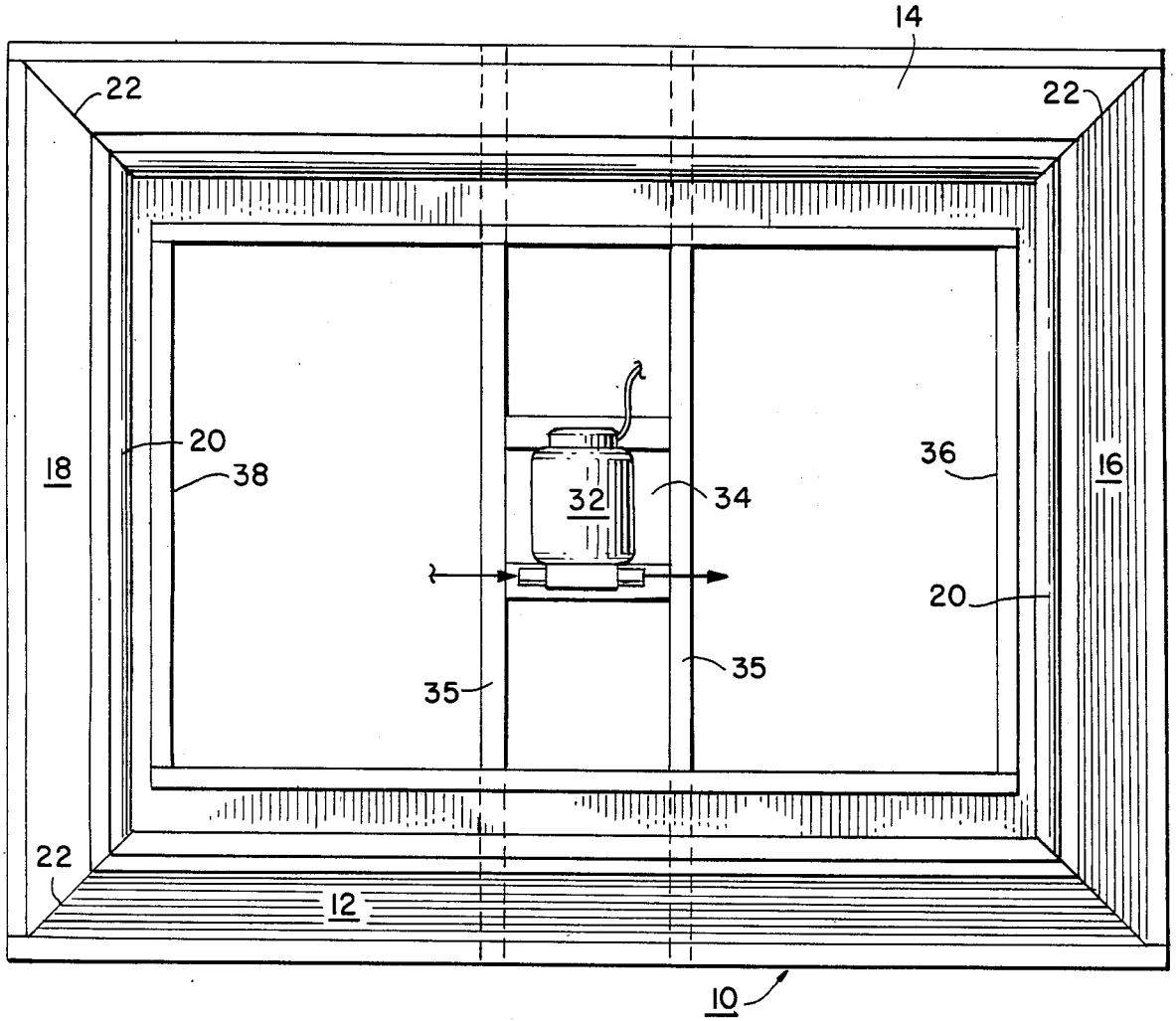
FIG. 3 is a top elevational view of the flotation section of FIG. 1.

With specific reference to FIG. 1, there is illustrated the present skimmer 10 having right and left side weirs 12 and 14 respectively, and fore and aft weirs 16 and 18 respectively. These weirs are rendered bouyant by some suitable means 20 which may be either atop the weir, or preferably along the inner side of the weir. The bouyant material may be, for example, styrofoam because of its inexpensive, readily configurated characteristics.

Although FIG. 1 illustrates the weirs in closed position, it will be readily apparent that each weir is joined to an adjacent weir along the mating edges by means of a collapsible water-proof diaphragm. Thus, as the weirs open to block out further entry of oil and water, the pivotal movement opening the weirs increases the area near the mating end surfaces. However, because of the presence of water-proof flexible diaphragm, water-oil is effectively blocked from entering or flooding the unit from the open edge surfaces. These collapsible water-proof diaphragms are located at locations 22. In turn, the weirs pivot on hinges 24 which join to form hull 26 defined by side members 26 and tapered base members 28. A screen 30 is positioned in an open area at the base of the hull such that the skimmer 10 may be readily removed from the water by lifting, the excess water and contaminants if any, simply leaving the hull through the opening. A second purpose of the screen is to capture any debris which may be captured in the hull and which is not drawn out by pump 32 supported by horizontal member 34 joining vertical partitions 36.

It will be noted that vertical partitions 36 form a moat 38 along the outer perimeter of skimmer 10.

Figure 4:
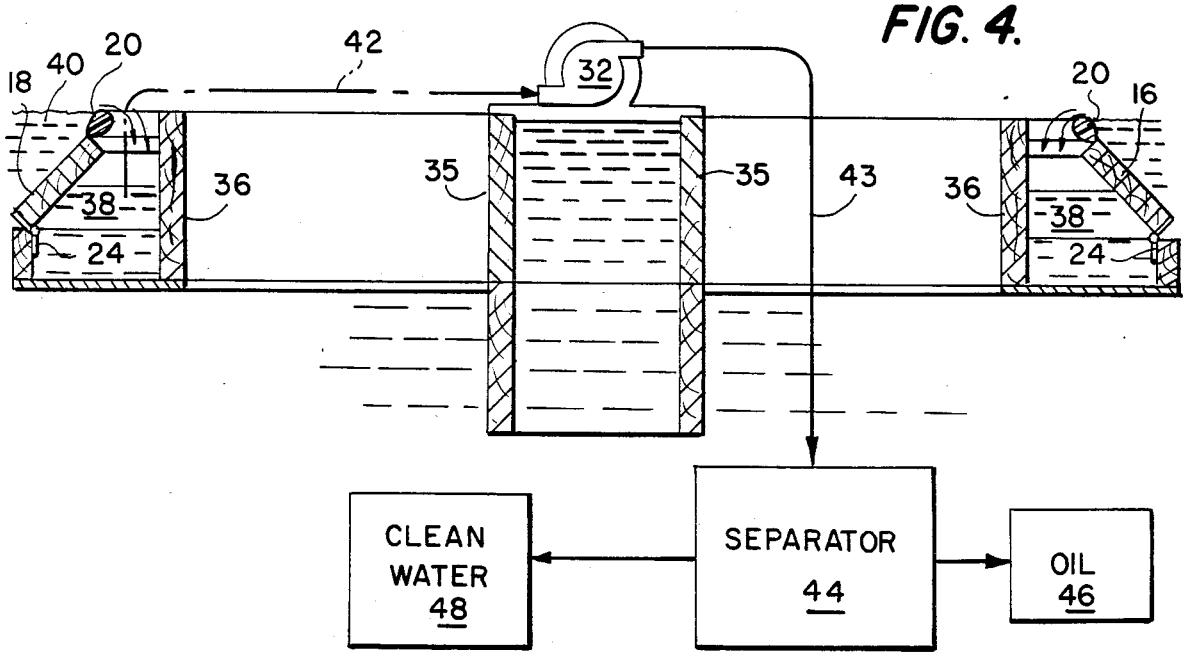
FIG. 4 is a partial sectional view taken along sectional lines 4—4 of FIG. 2, illustrating the present system in partial diagramatical form.

With reference to FIG. 4, operation of the present skimmer is depicted. Oil-water contamination 40 cascades over weirs 16 and 18 into moat 38 from which pump 32 continuously draws fluid by line 42, passing the contamination to separator 44 from which oil is spearated and captured in basin 46, with clear water being captured in basin 48.

Practice of the present invention will become more apparent from the following examples:

EXAMPLE 1

A skimmer is constructed using the construction of FIG. 1, except that the pump is submerged in the water-oil contained in the hull of the unit. One length of the unit is five (5) feet in length, and the opposite legs of the unit are seven (7) feet in length giving approximately 212 inches of cascade length. Using a submerged pump rated at one (1) horsepower, it is found that as much as 161 gallons per minute of oil contaminated water can be removed. This approximates 231,000 gallons per day of more concentrated oil to water. In effect, given a unit of this size, one can effectively clean a one (1) acre pond of contaminating oil slick in about four (4) days. In operation, one can actually see the oil phase moving over the contaminated water and into the hull of the unit from which it is pumped to an oil-water separator for final processing.

By passing the water-oil from the hull of the unit to a suitably sized separator to handle the water-oil flow being pumped, one can efficiently separate the oil from the water, returning the clean water to the environment as required, and recovering the oil, for recycle or disposal as desired.

It will be apparent to those skilled in the art that various changes and modifications may be made in the details of the specification without departing from the spirit of the invention and as either disclosed or claimed.

What is claimed is:

1. A system for recovering water-light pollutants immiscible with water from the surface of contaminated water, said system which comprises in combination:

(A) a hull submersible in water to be processed, said hull having an opening along the bottom thereof which is in open contact with the water to be processed and for permitting water entry into the central portion of the hull such that the entire hull will be substantially submerged when disposed in water to be processed, said hull having a vertically disposed frame defining an inner surface of a moat which extends about the perimeter of the hull, said moat having side members which are disposed oppositely to said vertically disposed frame and extending about the perimeter of the hull, said side members being joined to inwardly tapered base members which define said opening at an edge opposite the side members;

(B) pivotal weir members disposed oppositely to the vertically disposed frame and extending about the perimeter of the moat, said pivotal weir members joined by a flexible membrane to the top surface of the side members, said pivotal weir members configurated for limiting water and pollutants entry into the moat when the pivotal weir members are pivoted away from the vertically disposed frame and to the upright position, said pivotal weir members configurated for providing a cascade of water and pollutants into the moat when the pivotal weir members are pivoted toward the vertically disposed frame and to a lowered position, said pivotal weir members being raised to the upright position and lowered to the lowered position by buoyant means and the weight of water and contaminants in the moat; and (C) a pump for withdrawing pollutants and water from the moat.

2. The system of claim 1 further including a separator, said separator disposed to receive recovered cascaded pollutants and water, said separator configured to concentrate the pollutants for recovery, and to substantially purify the water.

3. The system of claim 1 wherein said buoyant means are disposed along the inner surface of the pivotal weir members.

4. The system of claim 1 wherein said buoyant means are disposed along the upper edge of the pivotal weir members opposite to the edge joined by the flexible membrane to the side members.

5. The system of claim 1 wherein the pump is disposed on the hull above the water being processed.

6. The system of claim 1 wherein the pump is disposed within the hull and below the water being processed.

7. The system of claim 1 wherein the flexible membrane is a water-proof flexible diaphragm.

* * * * *